US010551056B2

(12) United States Patent
Caloca et al.

(10) Patent No.: US 10,551,056 B2
(45) Date of Patent: Feb. 4, 2020

(54) BURNER BASE

(71) Applicant: WHIRLPOOL CORPORATION, Benton Harbor, MI (US)

(72) Inventors: Victor Gerardo Caloca, Guanajuato (MX); Tao Geng, St. Joseph, MI (US); Victor Manrique, St. Joseph, MI (US); Ana Katia Silva, Guanajuato (MX)

(73) Assignee: Whirlpool Corporation, Benton Harbor, MI (US)

( * ) Notice: Subject to any disclaimer, the term of this patent is extended or adjusted under 35 U.S.C. 154(b) by 263 days.

(21) Appl. No.: 15/440,774

(22) Filed: Feb. 23, 2017

(65) Prior Publication Data

US 2018/0238537 A1 Aug. 23, 2018

(51) Int. Cl.
*F23D 14/06* (2006.01)

(52) U.S. Cl.
CPC ..... *F23D 14/06* (2013.01); *F23D 2203/00* (2013.01)

(58) Field of Classification Search
None
See application file for complete search history.

(56) References Cited

U.S. PATENT DOCUMENTS

| | | | |
|---|---|---|---|
| 1,141,176 | A | 6/1915 | Copeman |
| 1,380,656 | A | 6/1921 | Lauth |
| 1,405,624 | A | 2/1922 | Patterson |
| 1,598,996 | A | 9/1926 | Wheelock |
| 1,808,550 | A | 6/1931 | Harpman |
| 2,024,510 | A | 12/1935 | Crisenberry |
| 2,530,991 | A | 11/1950 | Reeves |
| 2,536,613 | A | 1/1951 | Schulze et al. |

(Continued)

FOREIGN PATENT DOCUMENTS

| | | | |
|---|---|---|---|
| CA | 2365023 | A1 | 7/2002 |
| CA | 2734926 | A1 | 10/2011 |

(Continued)

OTHER PUBLICATIONS

Built-In Gas Cooktop, image post date Feb. 18, 2015, originally cited by Examiner in U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.

(Continued)

*Primary Examiner* — Avinash A Savani
*Assistant Examiner* — Martha M Becton
(74) *Attorney, Agent, or Firm* — Price Heneveld LLP

(57) ABSTRACT

A burner base for a stacked burner assembly to secure a uniform distribution of gas flow. The burner base couples with a top burner cover and together define an internal gas mixture chamber. The burner base includes a barrier structure along a perimeter having a plurality of structural zones. A first structural zone includes a semi-circular barrier structure having a height that is taller at a middle portion than at the end portions. A second structural zone includes an arc structure having a height that is taller than the heights of adjacent structural zone heights. A third structural zone includes a semi-circular structure having a consistent height along the structure. A fourth structural zone includes a non-raised semi-circular structure. The barrier structure is configured to facilitate the distribution of the gas within the mixture chamber.

10 Claims, 10 Drawing Sheets

(56) References Cited

U.S. PATENT DOCUMENTS 2,699,912 A 1/1955 Cushman
2,777,407 A 1/1957 Schindler
2,781,038 A 2/1957 Sherman
2,791,366 A 5/1957 Geisler
2,815,018 A 12/1957 Collins
2,828,608 A 4/1958 Cowlin et al.
2,847,932 A 8/1958 More
2,930,194 A 5/1960 Perkins
2,934,957 A 5/1960 Reinhart et al.
D191,085 S 8/1961 Kindl et al.
3,017,924 A 1/1962 Jenson
3,051,813 A 8/1962 Busch et al.
3,065,342 A 11/1962 Worden
3,089,407 A 5/1963 Kinkle
3,259,120 A 7/1966 Keating
3,289,731 A * 12/1966 Geber ..... F23D 14/06 126/39 R
3,386,431 A 6/1968 Branson
3,463,138 A 8/1969 Lotter et al.
3,548,154 A 12/1970 Christiansson
3,602,131 A 8/1971 Dadson
3,606,612 A * 9/1971 Reid, Jr. ..... F23D 14/145 431/281
3,645,249 A 2/1972 Henderson et al.
3,691,937 A 9/1972 Meek et al.
3,777,985 A 12/1973 Hughes et al.
3,780,954 A 12/1973 Genbauffs
3,857,254 A 12/1974 Lobel
3,877,865 A 4/1975 Duperow
3,899,655 A 8/1975 Skinner
D245,663 S 9/1977 Gordon
4,104,952 A 8/1978 Brass
4,149,518 A 4/1979 Schmidt et al.
4,363,956 A 12/1982 Scheidler et al.
4,413,610 A 11/1983 Berlik
4,418,456 A 12/1983 Riehl
4,447,711 A 5/1984 Fischer
4,466,789 A 8/1984 Riehl
4,518,346 A * 5/1985 Pistien ..... F23D 14/725 126/39 H
4,565,523 A * 1/1986 Berkelder ..... F23D 14/065 126/39 E
4,587,946 A 5/1986 Doyon et al.
4,646,963 A 3/1987 Delotto et al.
4,654,508 A 3/1987 Logel et al.
4,689,961 A 9/1987 Stratton
4,812,624 A 3/1989 Kern
4,818,824 A 4/1989 Dixit et al.
4,846,671 A 7/1989 Kwiatek
4,886,043 A 12/1989 Homer
4,891,936 A 1/1990 Shekleton et al.
D309,398 S 7/1990 Lund
4,981,416 A 1/1991 Nevin et al.
4,989,404 A 2/1991 Shekleton
5,021,762 A 6/1991 Hetrick
5,083,915 A * 1/1992 Riehl ..... F24C 3/103 126/39 E
5,112,218 A * 5/1992 Sigler ..... F24C 3/103 126/39 E
5,136,277 A 8/1992 Civanelli et al.
5,152,276 A * 10/1992 Brock ..... F24C 3/103 126/39 E
5,160,256 A * 11/1992 Riehl ..... F24C 3/103 126/39 BA
5,171,951 A 12/1992 Chartrain et al.
D332,385 S 1/1993 Adams
5,215,074 A 6/1993 Wilson et al.
5,243,172 A 9/1993 Hazan et al.
D340,383 S 10/1993 Addison et al.
5,266,026 A * 11/1993 Riehl ..... F23D 14/06 126/39 E
5,272,317 A 12/1993 Ryu
D342,865 S 1/1994 Addison et al.
5,316,423 A 5/1994 Kin
5,328,357 A * 7/1994 Riehl ..... F23D 14/06 126/39 E
5,397,234 A * 3/1995 Kwiatek ..... F24C 3/103 431/264
5,448,036 A 9/1995 Husslein et al.
D364,993 S 12/1995 Andrea
5,491,423 A 2/1996 Turetta
D369,517 S 5/1996 Ferlin
5,571,434 A 11/1996 Cavener et al.
D378,578 S 3/1997 Eberhardt
5,618,458 A 4/1997 Thomas
5,649,822 A * 7/1997 Gertler ..... F23D 14/06 126/39 E
5,785,047 A 7/1998 Bird et al.
5,842,849 A 12/1998 Huang
5,913,675 A 6/1999 Vago et al.
D414,377 S 9/1999 Huang
5,961,311 A * 10/1999 Moore, Jr. ..... F23N 5/123 126/39 E
5,967,021 A 10/1999 Yung
6,016,096 A 1/2000 Barnes et al.
6,030,207 A 2/2000 Salmi
6,035,846 A * 3/2000 Saleri ..... F23D 14/06 126/39 H
6,049,267 A 4/2000 Barnes et al.
6,050,176 A 4/2000 Schultheis et al.
6,067,978 A * 5/2000 Schlosser ..... A47J 37/0713 126/39 E
6,078,243 A 6/2000 Barnes et al.
6,089,219 A 7/2000 Kodera et al.
6,092,518 A 7/2000 Dane
6,111,229 A 8/2000 Schultheis
6,114,665 A 9/2000 Garcia et al.
6,133,816 A 10/2000 Barnes et al.
6,155,820 A 12/2000 Döbbeling
6,188,045 B1 2/2001 Hansen et al.
6,192,669 B1 2/2001 Keller et al.
6,196,113 B1 3/2001 Yung
6,253,759 B1 7/2001 Giebel et al.
6,253,761 B1 7/2001 Shuler et al.
6,263,868 B1 * 7/2001 Koch ..... F23D 14/06 126/39 E
6,320,169 B1 11/2001 Clothier
6,322,354 B1 11/2001 Carbone et al.
6,362,458 B1 3/2002 Sargunam et al.
6,452,136 B1 9/2002 Berkcan et al.
6,452,141 B1 9/2002 Shon
6,589,046 B2 7/2003 Harneit
6,614,006 B2 9/2003 Pastore et al.
6,619,280 B1 9/2003 Zhou et al.
6,655,954 B2 12/2003 Dane
6,663,009 B1 12/2003 Bedetti et al.
6,663,025 B1 * 12/2003 Halsey ..... C23C 14/566 118/715
6,712,605 B2 * 3/2004 Moresco ..... F23D 14/06 126/39 E
6,718,965 B2 4/2004 Rummel et al.
6,733,146 B1 5/2004 Vastano
6,806,444 B2 10/2004 Lerner
6,837,151 B2 1/2005 Chen
6,891,133 B2 5/2005 Shozo et al.
6,910,342 B2 6/2005 Berns et al.
6,930,287 B2 8/2005 Gerola et al.
6,953,915 B2 10/2005 Garris, III
7,017,572 B2 * 3/2006 Cadima ..... F23D 14/06 126/39 E
D524,105 S 7/2006 Poltronieri
7,083,123 B2 * 8/2006 Molla ..... F23D 14/06 239/267
7,220,945 B1 5/2007 Wang
D544,753 S 6/2007 Tseng
7,274,008 B2 9/2007 Arnal Valero et al.
7,281,715 B2 10/2007 Boswell
7,291,009 B2 11/2007 Kamal et al.
7,315,247 B2 1/2008 Jung et al.
7,325,480 B2 2/2008 Grühbaum et al.
D564,296 S 3/2008 Koch et al.
7,348,520 B2 3/2008 Wang

(56) References Cited

U.S. PATENT DOCUMENTS 7,368,685 B2 5/2008 Nam et al.
7,411,160 B2 8/2008 Duncan et al.
7,414,203 B2 8/2008 Winkler
7,417,204 B2 8/2008 Nam et al.
D581,736 S 12/2008 Besseas
7,468,496 B2 12/2008 Marchand
D592,445 S 5/2009 Sorenson et al.
7,527,495 B2 5/2009 Yam et al.
D598,959 S 8/2009 Kiddoo
7,589,299 B2 9/2009 Fisher et al.
7,594,812 B2 * 9/2009 Armanni ..... F23D 14/06 126/39 E
D604,098 S 11/2009 Hamlin
7,614,877 B2 11/2009 McCrorey et al.
7,628,609 B2 12/2009 Pryor et al.
7,640,930 B2 1/2010 Little et al.
7,696,454 B2 4/2010 Nam et al.
7,708,008 B2 5/2010 Elkasevic et al.
7,721,727 B2 5/2010 Kobayashi
7,731,493 B2 6/2010 Starnini et al.
7,762,250 B2 7/2010 Elkasevic et al.
7,781,702 B2 8/2010 Nam et al.
7,823,502 B2 11/2010 Hecker et al.
7,829,825 B2 11/2010 Kuhne
7,841,333 B2 11/2010 Kobayashi
7,964,823 B2 6/2011 Armstrong et al.
D642,675 S 8/2011 Scribano et al.
8,006,687 B2 8/2011 Watkins et al.
8,015,821 B2 9/2011 Spytek
8,037,689 B2 10/2011 Oskin et al.
8,057,223 B2 11/2011 Pryor et al.
8,141,549 B2 3/2012 Armstrong et al.
8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,344,292 B2 1/2013 Franca et al.
8,393,317 B2 3/2013 Sorenson et al.
8,398,303 B2 3/2013 Kuhn
3,430,310 A1 4/2013 Ho et al.
8,408,897 B2 * 4/2013 Rossi ..... F23D 14/06 126/214 A
8,464,703 B2 6/2013 Ryu et al.
D685,225 S 7/2013 Santoyo et al.
D687,675 S 8/2013 Filho et al.
8,526,935 B2 9/2013 Besore et al.
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,689,782 B2 4/2014 Padgett
8,707,945 B2 4/2014 Hasslberger et al.
8,747,108 B2 6/2014 Lona Santoyo et al.
8,753,112 B2 * 6/2014 Armanni ..... F23D 14/065 126/39 E
8,800,543 B2 8/2014 Simms et al.
8,845,326 B2 * 9/2014 Shaffer ..... F23D 14/06 126/39 E
D718,061 S 11/2014 Wu
8,887,710 B2 11/2014 Rossi et al.
8,930,160 B2 1/2015 Wall et al.
8,932,049 B2 * 1/2015 Ryu ..... F23D 14/06 126/39 E
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.
9,074,765 B2 7/2015 Armanni
D735,525 S 8/2015 Nguyen
9,113,503 B2 8/2015 Arnal Valero et al.
9,132,302 B2 9/2015 Luongo et al.
D743,203 S 11/2015 Filho et al.
9,175,858 B2 11/2015 Tisselli et al.
D750,314 S 2/2016 Hobson et al.
9,307,888 B2 4/2016 Baldwin et al.
D758,107 S 6/2016 Hamilton
D766,036 S 9/2016 Koch et al.
D766,696 S 9/2016 Kemker
9,513,015 B2 12/2016 Estrella et al.
9,521,708 B2 12/2016 Adelmann et al.
9,557,063 B2 1/2017 Cadima
9,572,475 B2 2/2017 Gephart et al.
9,644,847 B2 5/2017 Bhogal et al.
9,651,247 B2 * 5/2017 Scheuring, III ..... F23D 14/04
9,696,042 B2 7/2017 Hasslberger et al.
9,927,129 B2 3/2018 Bhogal et al.
9,989,248 B2 * 6/2018 Angulo ..... F23L 9/00
10,352,558 B2 * 7/2019 Angulo
10,393,386 B2 * 8/2019 Gasparini
10,393,387 B2 * 8/2019 Cadima
2002/0065039 A1 5/2002 Benezech et al.
2003/0000512 A1 * 1/2003 Moresco ..... F23D 14/06 126/1 R
2003/0075164 A1 * 4/2003 Dane ..... F23D 14/06 126/39 R
2004/0007566 A1 1/2004 Staebler et al.
2004/0031782 A1 2/2004 Westfield
2004/0195399 A1 * 10/2004 Molla ..... F23D 14/06 239/594
2004/0224273 A1 11/2004 Inomata
2004/0224274 A1 11/2004 Tomiura
2004/0241604 A1 * 12/2004 Cadima ..... F23D 14/06 431/354
2005/0029245 A1 2/2005 Gerola et al.
2005/0112520 A1 5/2005 Todoli et al.
2005/0199232 A1 9/2005 Gama et al.
2005/0268794 A1 12/2005 Nesterov
2007/0124972 A1 6/2007 Ratcliffe
2007/0141521 A1 * 6/2007 Armanni ..... F23D 14/06 431/354
2007/0181410 A1 8/2007 Baier
2007/0281267 A1 12/2007 Li
2008/0029081 A1 2/2008 Gagas
2008/0050687 A1 2/2008 Wu
2008/0173632 A1 7/2008 Jang et al.
2008/0210685 A1 9/2008 Beier
2008/0241777 A1 * 10/2008 Rossi ..... F23D 14/06 431/354
2009/0173730 A1 7/2009 Baier et al.
2009/0320823 A1 12/2009 Padgett
2010/0035197 A1 2/2010 Cadima
2010/0114339 A1 5/2010 Kaiser et al.
2010/0126496 A1 5/2010 Luo et al.
2010/0154776 A1 6/2010 Czajka et al.
2010/0192939 A1 8/2010 Parks
2011/0142998 A1 6/2011 Johncook et al.
2011/0163086 A1 7/2011 Aldana Arjol et al.
2011/0248021 A1 10/2011 Gutierrez et al.
2012/0017595 A1 1/2012 Liu
2012/0024835 A1 2/2012 Artal Lahoz et al.
2012/0036855 A1 2/2012 Hull
2012/0067334 A1 3/2012 Kim et al.
2012/0070791 A1 * 3/2012 Armanni ..... F23D 14/065 431/354
2012/0076351 A1 3/2012 Yoon et al.
2012/0099761 A1 4/2012 Yoon et al.
2012/0160228 A1 6/2012 Kim et al.
2012/0171343 A1 7/2012 Cadima et al.
2012/0261405 A1 10/2012 Kurose et al.
2013/0043239 A1 2/2013 Anton Falcon et al.
2013/0252188 A1 9/2013 Chen
2013/0255663 A1 10/2013 Cadima et al.
2013/0260618 A1 10/2013 Bally et al.

(56) References Cited

U.S. PATENT DOCUMENTS

| | | | | |
|---|---|---|---|---|
| 2013/0269676 | A1* | 10/2013 | Quintaba' | F23D 14/065 126/39 E |
| 2014/0048055 | A1 | 2/2014 | Ruther | |
| 2014/0060517 | A1* | 3/2014 | Ren | F23D 14/065 126/39 E |
| 2014/0071019 | A1 | 3/2014 | Lim | |
| 2014/0090636 | A1 | 4/2014 | Bettinzoli | |
| 2014/0097172 | A1 | 4/2014 | Kang et al. | |
| 2014/0116416 | A1 | 5/2014 | Saubert | |
| 2014/0137751 | A1 | 5/2014 | Bellm | |
| 2014/0139381 | A1 | 5/2014 | Sippel | |
| 2014/0318527 | A1 | 10/2014 | Silva et al. | |
| 2014/0352549 | A1 | 12/2014 | Upston et al. | |
| 2015/0107577 | A1* | 4/2015 | Jeong | F24C 3/08 126/39 E |
| 2015/0136760 | A1 | 5/2015 | Lima et al. | |
| 2015/0153041 | A1 | 6/2015 | Neumeier | |
| 2015/0241069 | A1 | 8/2015 | Brant et al. | |
| 2015/0253012 | A1* | 9/2015 | Faveri | F23D 14/02 126/39 E |
| 2015/0330640 | A1 | 11/2015 | Stork gennant Wersborg | |
| 2015/0345800 | A1 | 12/2015 | Cabrera Botello | |
| 2015/0359045 | A1 | 12/2015 | Neukamm et al. | |
| 2016/0029439 | A1 | 1/2016 | Kurose et al. | |
| 2016/0061490 | A1 | 3/2016 | Cho et al. | |
| 2016/0091210 | A1 | 3/2016 | Ceccoli | |
| 2016/0116160 | A1 | 4/2016 | Takeuchi | |
| 2016/0153666 | A1 | 6/2016 | Tcaciuc | |
| 2016/0174768 | A1 | 6/2016 | Deverse | |
| 2016/0178209 | A1 | 6/2016 | Park et al. | |
| 2016/0178212 | A1 | 6/2016 | Park et al. | |
| 2016/0187002 | A1 | 6/2016 | Ryu et al. | |
| 2016/0201902 | A1 | 7/2016 | Cadima | |
| 2016/0209044 | A1 | 7/2016 | Cadima | |
| 2016/0209045 | A1 | 7/2016 | Millius | |
| 2016/0295644 | A1 | 10/2016 | Khokle et al. | |
| 2016/0296067 | A1 | 10/2016 | Laws | |
| 2017/0003033 | A1 | 1/2017 | Lona Santoyo et al. | |
| 2017/0067651 | A1 | 3/2017 | Khokle et al. | |
| 2017/0074522 | A1 | 3/2017 | Cheng | |
| 2017/0082296 | A1 | 3/2017 | Jeong et al. | |
| 2017/0082299 | A1 | 3/2017 | Rowley et al. | |
| 2017/0108228 | A1 | 4/2017 | Park et al. | |
| 2017/0115008 | A1 | 4/2017 | Erbe et al. | |
| 2017/0261213 | A1 | 4/2017 | Park et al. | |
| 2017/0223774 | A1 | 8/2017 | Cheng et al. | |
| 2018/0058702 | A1 | 3/2018 | Jang et al. | |
| 2018/0073730 | A1* | 3/2018 | Acosta Herrero | F24C 3/085 |
| 2018/0195719 | A1* | 7/2018 | Angulo | F23L 9/00 |

FOREIGN PATENT DOCUMENTS

| | | | |
|---|---|---|---|
| CN | 201680430 | U | 12/2010 |
| DE | 2845869 | A1 | 4/1980 |
| DE | 3014908 | A1 | 10/1981 |
| DE | 3446621 | A1 | 6/1986 |
| DE | 3717728 | A1 | 12/1988 |
| DE | 3150450 | C2 | 8/1989 |
| DE | 3839657 | A1 | 5/1990 |
| DE | 4103664 | C1 | 1/1992 |
| DE | 4445594 | A1 | 6/1996 |
| DE | 10218294 | A1 | 11/2003 |
| DE | 60004581 | T2 | 6/2004 |
| DE | 19912452 | B4 | 10/2007 |
| DE | 102006034391 | A1 | 1/2008 |
| DE | 102007021297 | A1 | 11/2008 |
| DE | 102008027220 | A1 | 12/2009 |
| DE | 102009002276 | A1 | 10/2010 |
| DE | 102013218714 | A1 | 4/2014 |
| EP | 0122966 | A2 | 10/1984 |
| EP | 0429120 | A2 | 5/1991 |
| EP | 0620698 | A1 | 10/1994 |
| EP | 0690659 | A2 | 1/1996 |
| EP | 1030114 | A1 | 8/2000 |
| EP | 1217306 | A2 | 6/2002 |
| EP | 1344986 | A1 | 9/2003 |
| EP | 1586822 | A1 | 10/2005 |
| EP | 1099905 | B1 | 2/2006 |
| EP | 2063181 | A2 | 5/2009 |
| EP | 2063444 | A1 | 5/2009 |
| EP | 2116775 | A1 | 11/2009 |
| EP | 2116829 | A1 | 11/2009 |
| EP | 2278227 | A2 | 1/2011 |
| EP | 2299181 | A1 | 3/2011 |
| EP | 2375170 | A1 | 10/2011 |
| EP | 2144012 | B1 | 9/2012 |
| EP | 2657615 | A1 | 10/2013 |
| EP | 2816291 | A1 | 12/2014 |
| EP | 2835580 | A2 | 2/2015 |
| EP | 3006832 | A1 | 4/2016 |
| EP | 2848867 | B1 | 9/2017 |
| FR | 2787556 | A1 | 6/2000 |
| FR | 2789753 | A1 | 8/2000 |
| FR | 3003338 | A1 | 9/2014 |
| JP | 2001141244 | A | 5/2001 |
| JP | 2005009693 | A | 1/2005 |
| JP | 2007147131 | A | 6/2007 |
| JP | 2010038475 | A | 2/2010 |
| JP | 2011257021 | A | 12/2011 |
| WO | 1991013526 | A1 | 9/1991 |
| WO | 9850736 | A1 | 11/1998 |
| WO | 2006072388 | A1 | 7/2006 |
| WO | 2006136363 | A1 | 12/2006 |
| WO | 2012077050 | A2 | 6/2012 |
| WO | 2013098330 | A2 | 7/2013 |
| WO | 2013182410 | A1 | 12/2013 |
| WO | 2014194176 | A1 | 12/2014 |
| WO | 2015086420 | A1 | 6/2015 |

OTHER PUBLICATIONS

True-Heat burner, image post date Jan. 30, 2015, originally cited by Examiner in U.S. Application No. 29/539,768 n. Restriction Requirement dated Oct. 27, 2016, 2 pp., <http://ovens.reviewed.com/news/kitchenaid-has-a-new-lame>.

Metal Cover Gas Hob, image post date 2012, originally in U.S. Appl. No. 29/539,768 in Restriction Requirement dated Oct. 27, 2016, 13 pages, <http://inse.gmc.globalmarket.com/products/details/metal-cover-gas-hob-8516959.html>.

Penny Stove, image post date 2004, originally in U.S. Appl. No. 29/539,768 in Restriction Requirement dated Oct. 27, 2016, 30 pages, <http://www.jureystudio.com/pennystove/stoveinstruction.html>.

* cited by examiner

BURNER BASE

FIELD OF THE DISCLOSURE

The present disclosure generally relates to a burner base having a geometry that contributes to flow distribution within the burner mixture chamber.

SUMMARY OF THE DISCLOSURE

One aspect provides a burner base for a burner assembly, where the burner base defines a bottom surface for a gas mixture chamber. The burner base includes a first barrier structure disposed along a perimeter of the gas mixture chamber, a second barrier structure disposed along the perimeter of the gas mixture chamber adjacent to the first barrier structure, and a third barrier structure disposed along a perimeter of the gas mixture chamber adjacent to the second barrier structure. Further, the first barrier structure, the second barrier structure and the third barrier structure have different geometries.

Another aspect provides a burner assembly that defines a gas mixture chamber. The gas mixture chamber includes a structural zone located radially outwardly from a gas injection port. The structural zone includes a geometry having a middle portion and two end portions, and the middle portion geometry of the structural zone is different than end portion geometries of the structural zone.

Still another aspect provides a burner body for a burner assembly, where the burner body defines at least a portion of a gas mixture chamber. The burner body includes a first barrier structure disposed along a perimeter of the burner body, a second barrier structure disposed along the perimeter of the burner body adjacent to the first barrier structure, and a third barrier structure disposed along a perimeter of the burner body adjacent to the second barrier structure. Further, the first barrier structure, the second barrier structure and the third barrier structure have different geometries.

These and other features, advantages, and objects of the present disclosure will be further understood and appreciated by those skilled in the art by reference to the following specification, claims, and appended drawings.

BRIEF DESCRIPTION OF THE DRAWINGS

Further advantages and features according to the present disclosure will become clear from the following detailed description provided as a non-limiting example, with reference to the attached drawings in which.

DETAILED DESCRIPTION

Figure 1:
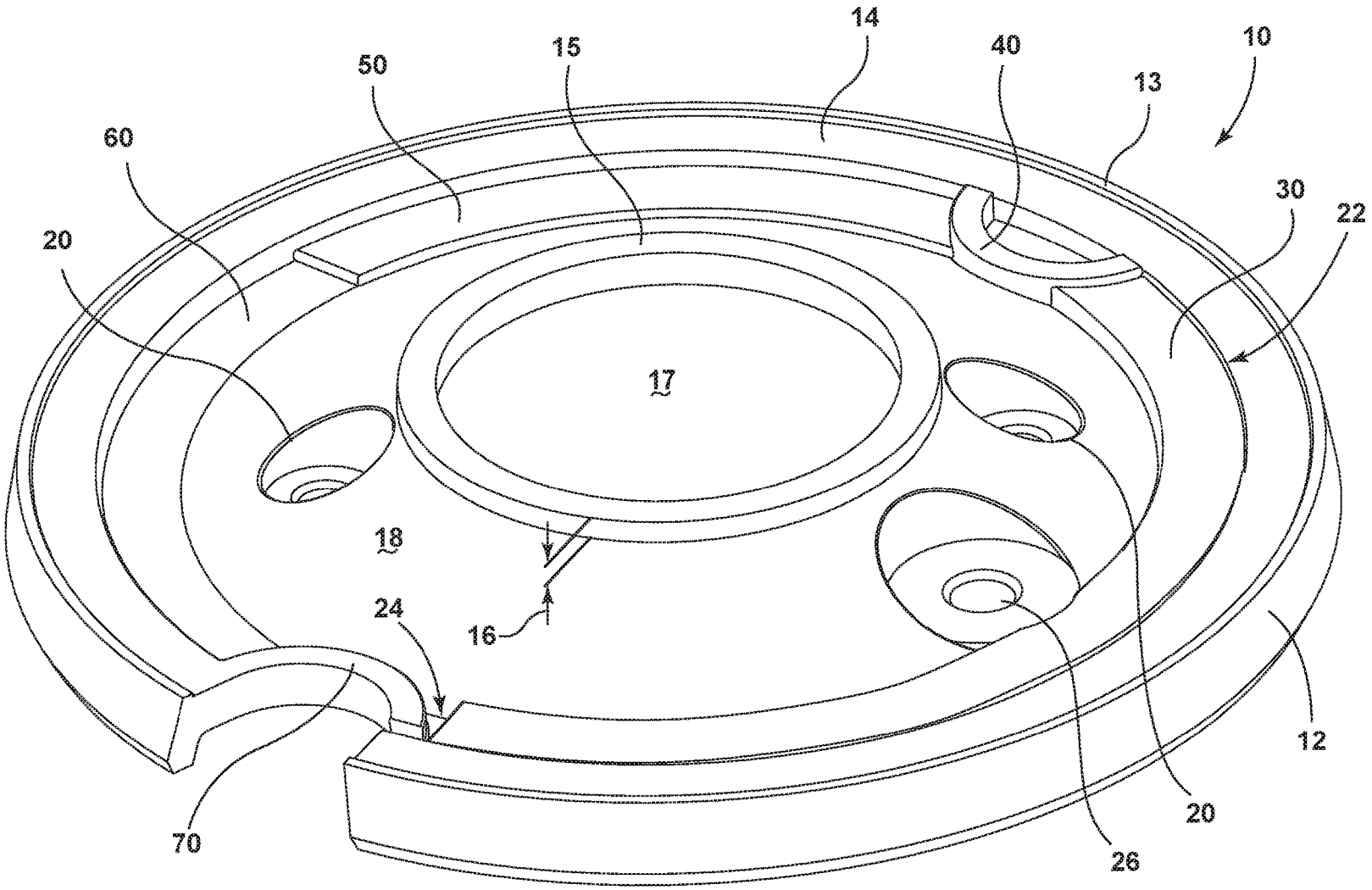
FIG. 1 is a top perspective view of a burner base, according to an embodiment of the present disclosure.

The present illustrated embodiments reside primarily in combinations of apparatus components related to a burner base 10 for a stack burner assembly 110, for use in a cooking appliance, such as cooking appliance 100. Accordingly, the apparatus components have been represented, where appropriate, by conventional symbols in the drawings, showing only those specific details that are pertinent to understanding the embodiments of the present disclosure. Further, like numerals in the description and drawings represent like elements.

It is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. For example, an element proceeded by "comprises a . . . " does not, without more constraints, preclude the existence of additional identical elements in the process, method, article, or apparatus that comprises the element.

For purposes of this disclosure, the term "coupled" (in all of its forms, couple, coupling, coupled, etc.) generally means the joining of two components directly or indirectly to one another. Such joining may be stationary in nature or movable in nature. Such joining may be achieved with the two components and any additional intermediate members being integrally formed as a single unitary body with one another or with the two components. Such joining may be permanent in nature or may be removable or releasable in nature unless otherwise stated.

Referring to the attached FIGS. 1-9B, the present disclosure provides a burner base for a burner assembly 110. As shown in the illustrated embodiment of FIGS. 4 and 5, burner base 10 may be coupled with a burner spreader 80, and, when positioned together, define a gas mixture chamber 112 within burner assembly 110. According to the present disclosure, burner base 10 may include a plurality of structural zones, each structural zone having a unique geometry to enable the distribution of gas around the burner assembly 110 and to facilitate an even flame for the burner. In at least one case, burner base 10 includes a first barrier structure 30 disposed in a first structural zone of a gas mixture chamber 112, a second barrier structure 40 disposed in a second structural zone of the gas mixture chamber 112, a third barrier structure 50 disposed in a third structural zone of the gas mixture chamber 112, and a fourth barrier structure 60 disposed in a fourth structural zone of the gas mixture chamber 112. The burner base 10 as well as other embodiments of gas burner assemblies contemplated herein will be discussed in more detail in the following paragraphs.

Figure 2:
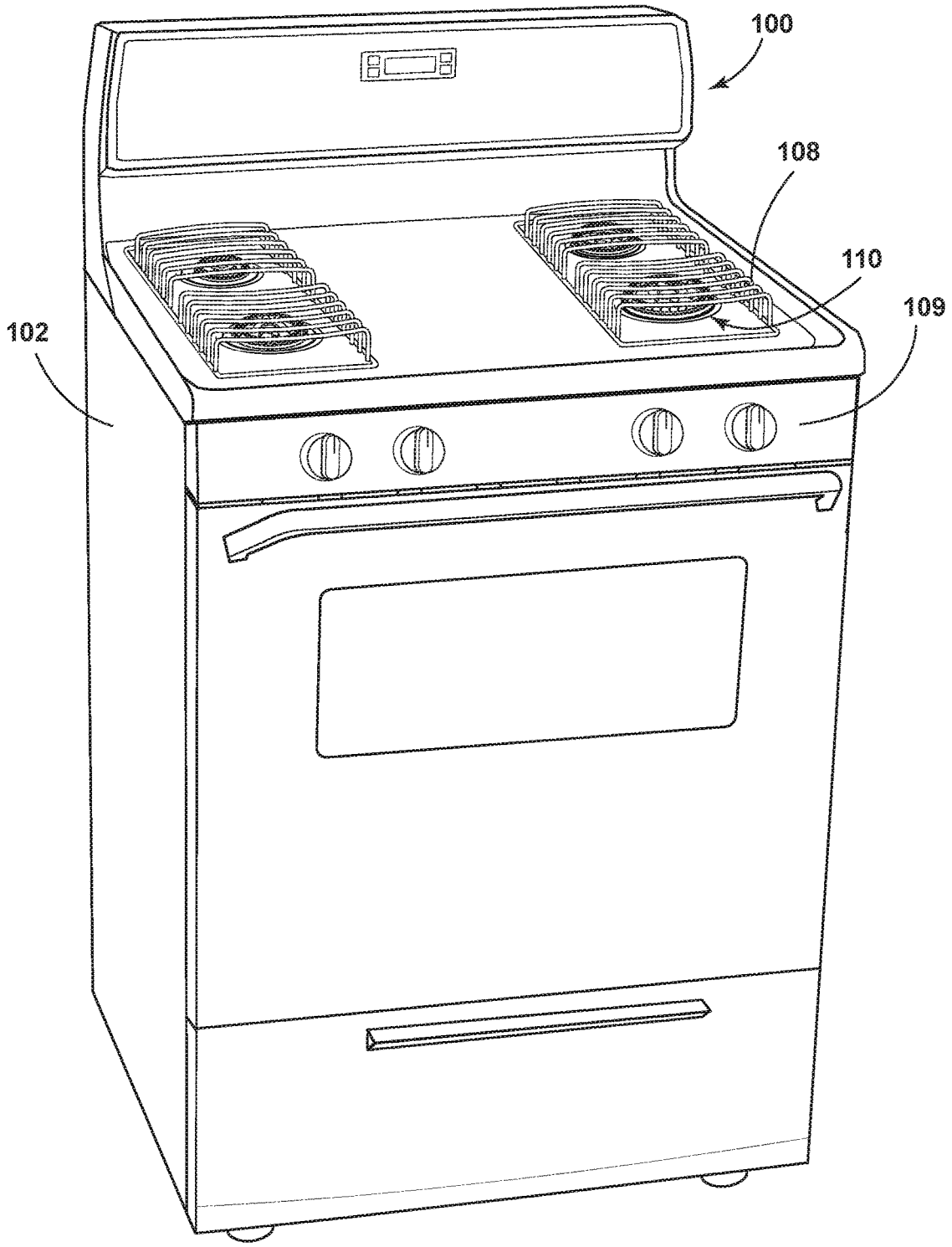
FIG. 2 is a top perspective view of a cooking appliance incorporating the burner base, according to an embodiment of the present disclosure.

The disclosed burner base and burner assembly may be incorporated into a gas cooktop cooking appliance as would be known in the art. FIG. 2 illustrates an exemplary free-standing cooking appliance 100 with which the described embodiments may be incorporated. The illustrated cooking appliance 100 includes an outer body or cabinet 102, a cooktop surface 104, an access door 106 for access to an oven cavity (not shown). Cooktop surface 104 includes a plurality of burner assemblies 110, described in more detail below. Burner assemblies 110 may be enclosed by a cooktop rack 108 for resting a pan thereon, and may be controlled by various burner controls 109. It will be understood, however, that the herein described burner base 10 and burner assembly 110 may be applicable to other types of cooktops, including those which do not form a top portion of a free-standing cooking appliance 100 as shown in FIG. 2, but also those such as built-in cooktops or commercial grade cabinet cooktops. Therefore, cooking appliance 100 is provided by way of illustration only and is not intended to limit the application of the burner base 10 and burner assembly 110 as described herein.

Figure 3:
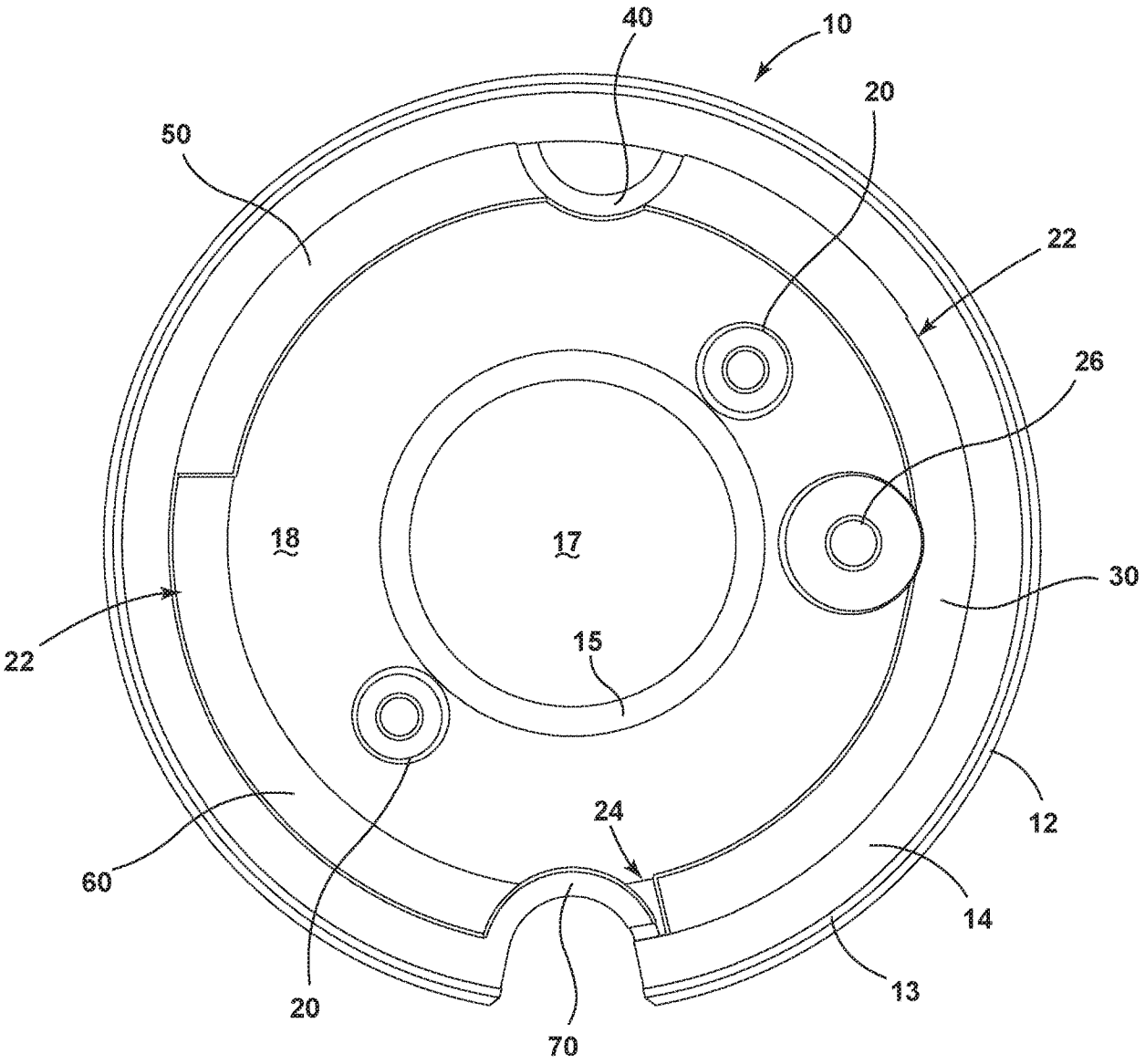
FIG. 3 is a top view of the burner base, according to an embodiment of the present disclosure.

FIGS. 1 and 3 depict a top perspective view and a top view, respectively, of a burner base 10 according to one embodiment described herein. Burner base 10 is configured as a portion of a burner assembly, such as burner assembly 110, which is configured to receive a gas injection for creating a cooking flame for cooking appliance 100. As described in more detail below, and referring to the embodiment depicted in FIGS. 4, 5, and 10, burner base 10 may be configured to receive a burner spreader 80, which together with burner base 10 creates a mixture chamber 112 formed in part by a bottom surface 18 of burner base 10 and a bottom surface 84 of burner spreader 80. Accordingly, because a surface of burner base 10 creates a portion of mixture chamber 112, the structural geometry of burner base 10 may affect the distribution of gas within mixture chamber 112.

In the illustrated embodiment, burner base 10 is configured as a substantially round disc that includes a perimeter edge structure 12 defining a portion of a perimeter of burner assembly 110. Perimeter edge structure 12 includes a top surface 14 as well as a barrier lip 13. Perimeter top surface 14 and barrier lip 13, together with openings 96 (FIG. 10) on bottom surface 84 of burner spreader 80 may serve as the exit structure through which a cooking flame may flow. In the central portion of burner base 10 an opening 17 may be defined with an internal perimeter lip 15. Internal perimeter lip 15, together with internal edge 87 of the bottom surface 84 of burner spreader 80 may create an internal barrier for gas mixture chamber 112.

According to one embodiment, the geometry of burner base 10 within mixture chamber 112 includes a sloped bottom surface 18 that extends from internal perimeter lip 15 down to first barrier structure 30, a second barrier structure 40, a third barrier structure 50, and fourth barrier structure 60. Burner base 10 also includes an ignition barrier structure 70, adjacent to an ignition passage 24. Ignition passage 24 may be coupled to an ignition source for burner assembly 110. For example, a spark may be introduced through ignition passage 24 to ignite gas contained within mixture chamber 112. Burner base 10 may also include one or more fixation apertures 20 for affixing burner base 10 or burner assembly 110 to a cooking appliance 100.

According to aspects of the present disclosure, a burner base may include structural features, geometries, and zones to help distribute the flow of gas within a mixture chamber in a predictable manner to create a more even flame around the associated burner assembly. For example, in some cases, a burner base may include one or more structural zones around a gas ignition port to help distribute the gas being released from the gas ignition port around the entirety of the burner assembly. In at least one case, as shown in the illustrated embodiment, burner base 10 may include at least four different structural zones to enable the distribution of gas. In the illustrated embodiment, burner base 10 includes a first structural zone having a first barrier structure 30, a second structural zone having a second barrier structure 40, a third structural zone having a third barrier structure 50, a fourth structural zone having a fourth barrier structure 60.

Figure 6A:
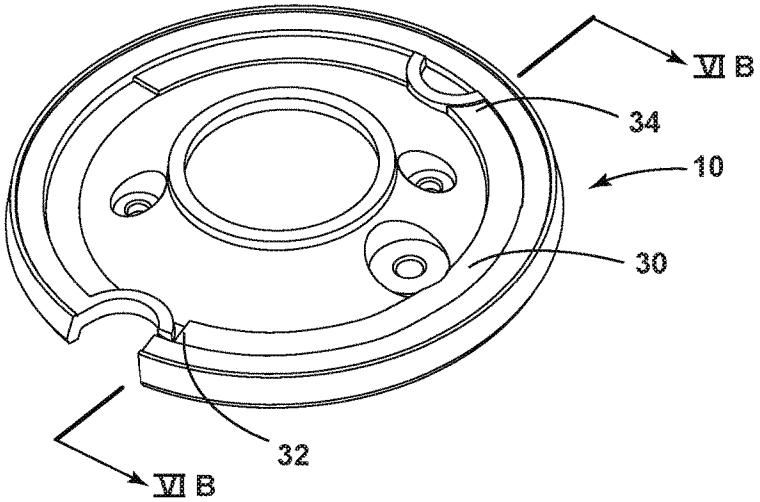
FIGS. 6A and 6B depict a side perspective view and a related cross-sectional view of the burner base, according to an embodiment of the present disclosure.
Figure 6B:
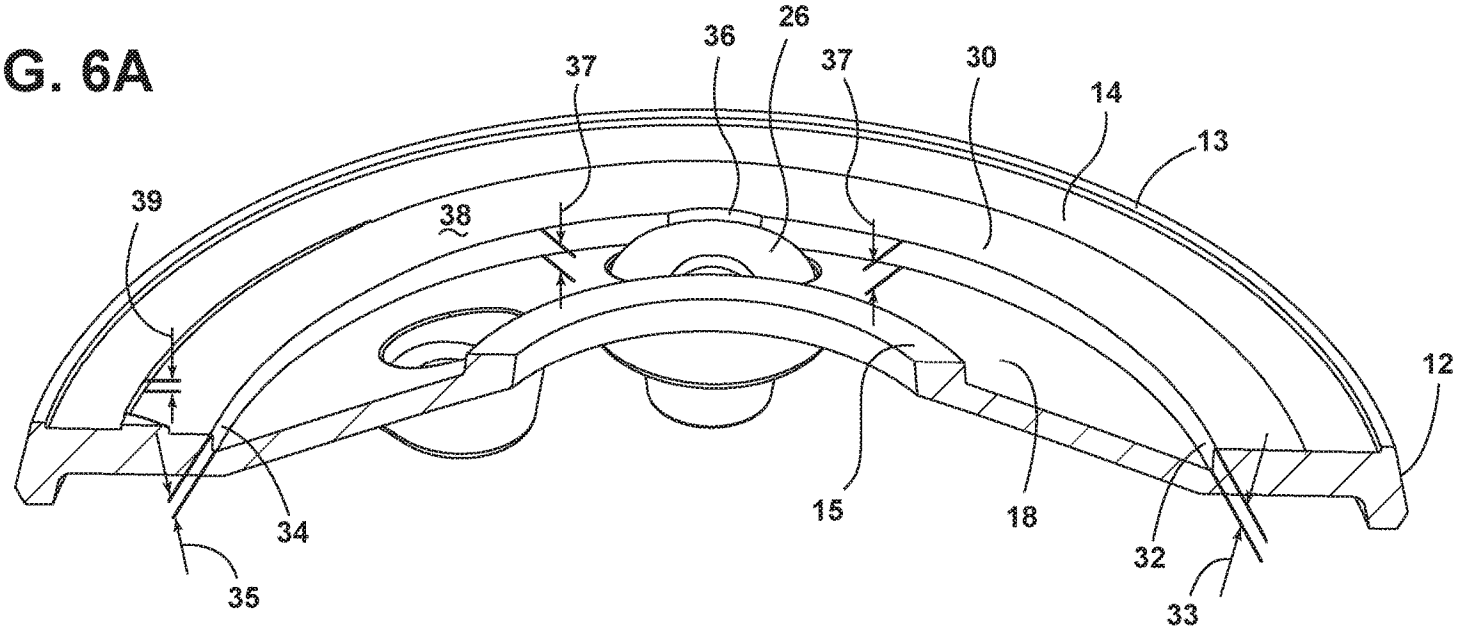

FIGS. 6A and 6B depict a top perspective view and a cross-sectional view, respectively, of a first structural zone having a first barrier structure 30 according to the illustrated embodiment. In particular, FIG. 6B is a top perspective cross-sectional view of first barrier structure 30 as shown across cross-sectional line VI B in FIG. 6A. The geometry of the first structural zone having first barrier structure 30 is situated around gas injection port 26, as shown in detail in FIG. 6B. Specifically, first structural zone includes sloped bottom surface 18 extending, at a high end, from internal perimeter lip 15 down to, and including, a first barrier structure 30 at a low end. As depicted, first barrier structure 30 includes a semi-circular projection above bottom surface 18 that is adjacent to perimeter top surface 14.

As illustrated, first barrier structure 30 includes a first end 32, a second end 34 and a middle section 36. First end 32 is proximate ignition barrier structure 70, and includes a first end height 33 as measured above bottom surface 18. Second end 34 is proximate second barrier structure 40, and includes a second end height 35 as measured above bottom surface 18. Middle section 36 is proximate gas injection port 26 and includes a middle section height 37 as measured above bottom surface 18. First barrier structure 30 may also include a top surface 38 which may be sloped or may be in the same plane as perimeter top surface 14. As illustrated in FIG. 6B, at first end 32, top surface 38 is in the same plane as perimeter top surface 14, and then gradually slopes down toward second end 34 such that there is a height difference at step down 39 between perimeter top surface 14 and top surface 38 at second end 34.

Referring to FIG. 6B, middle section height 37 may be different than first end height 33 and second end height 35. In at least one case, middle section height 37 is taller than first end height 33 as well as second end height 35. In still another case, first barrier structure 30 is symmetric such that the middle section height 37, directly proximate and on both sides of injection port 26, is substantially the same, and first end height 33 is substantially the same as second end height 35. In other cases, however, first barrier structure 30 and its associated heights may vary and not be perfectly symmetric around the entirety of the semi-circle.

Figure 7A:
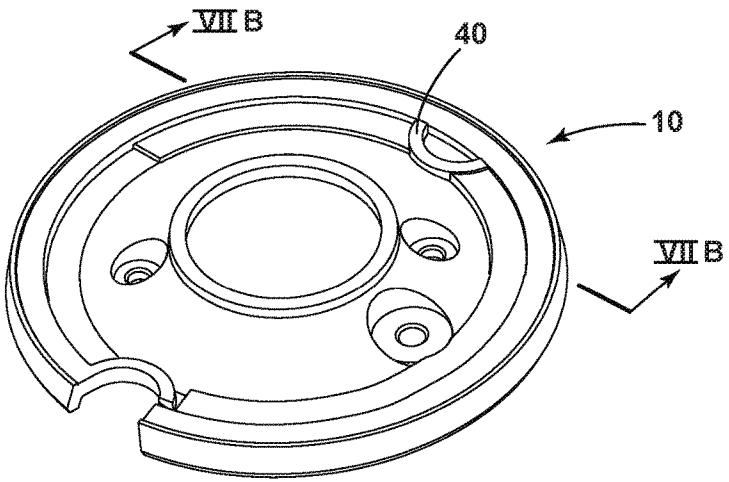
FIGS. 7A and 7B depict another side perspective view and a related cross-sectional view of the burner base, according to an embodiment of the present disclosure.
Figure 7B:
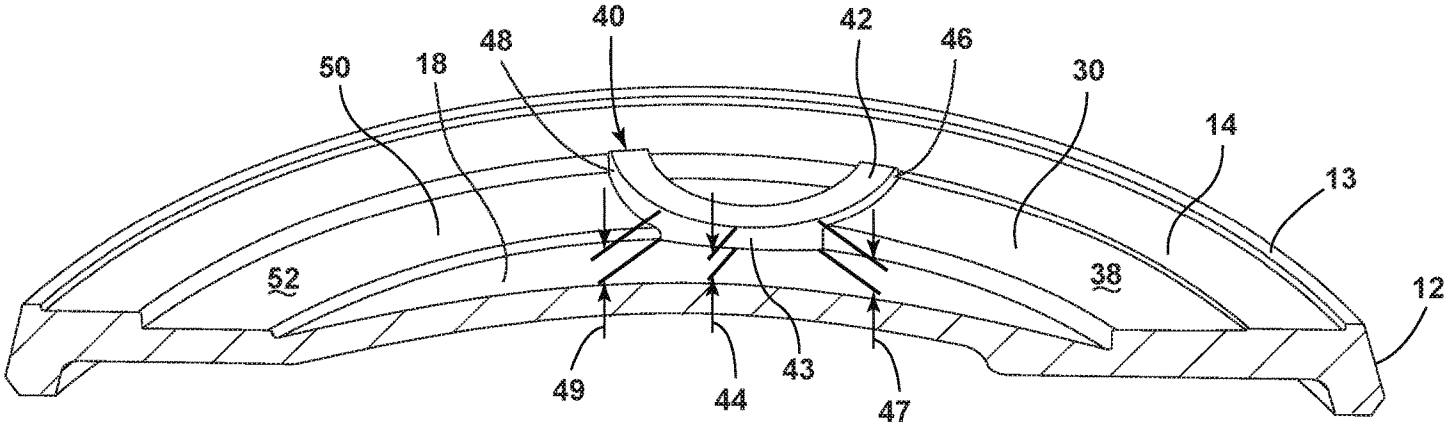

FIGS. 7A and 7B depict a top perspective view and a cross-sectional view, respectively, of a second structural zone having a second barrier structure 40 according to the illustrated embodiment. More specifically, FIG. 7B is a top perspective cross-sectional view of second barrier structure 40 as shown across cross-sectional line VII B in FIG. 7A. Second barrier structure 40 may be located between first barrier structure 30 and third barrier structure 50, and may be diametrically opposite from ignition barrier structure 70. In one embodiment, the geometry of the second structural zone consists of a semi-circular arc structure that rises above bottom surface 18, with a peak or midpoint 43 oriented toward the center of burner base 10, a first end 46 proximate perimeter top surface 14, and a second end 48 proximate perimeter top surface 14.

As shown in detail in the embodiment depicted in FIG. 7B, second barrier structure 40 rises above bottom surface 18 at a plurality of heights. First, second barrier structure 40 defines a midpoint height 44 at midpoint 43 from bottom surface 18 to a top surface 42. Second barrier structure 40 also defines a first interface height 47 and a second interface height 49. First interface height 47 is defined between bottom surface 18 and top surface 42 where second barrier structure 40 interfaces with first barrier structure 30. Second interface height 49 is defined between bottom surface 18 and top surface 42 where second barrier structure 40 interfaces with third barrier structure 50. In some cases midpoint height 44 is different than first interface height 47 and second interface height 49. In at least one embodiment, midpoint height 44 is smaller than first interface height 47 and second interface height 49. In the illustrated embodiment, first interface height 47 and second interface height 49 are equal, and larger, than midpoint height 44. Further, as can be seen in FIG. 7B, in at least one embodiment, second end 48 of second barrier structure 40 rises above a top surface 52 of third barrier structure 50 more than first end 46 of second barrier structure 40 rises above top surface 38 of first barrier structure 30.

Figure 8A:
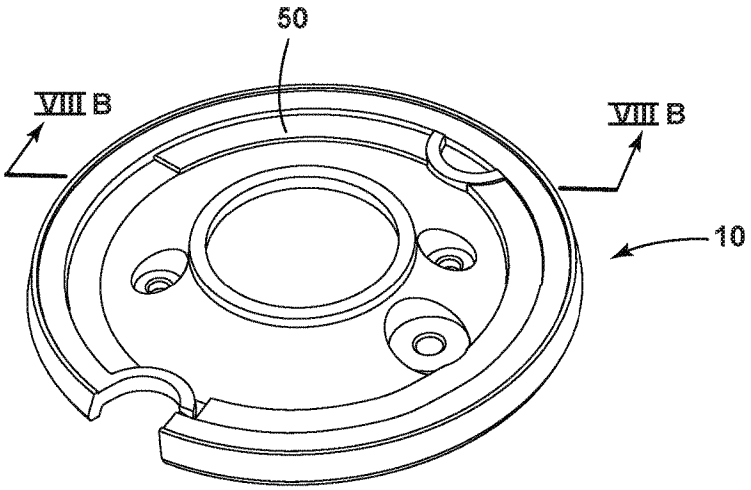
FIGS. 8A and 8B depict another side perspective view and a related cross-sectional view of the burner base, according to an embodiment of the present disclosure.
Figure 8B:
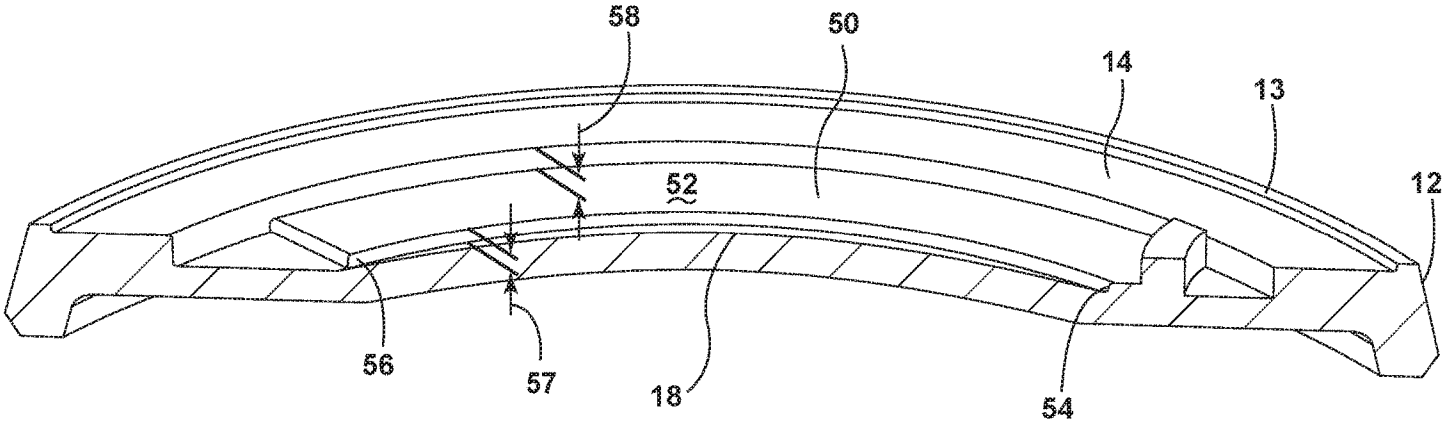

FIGS. 8A and 8B depict a top perspective view and a cross-sectional view, respectively, of a third structural zone having a third barrier structure 50 according to the illustrated embodiment. In particular, FIG. 8B is a top perspective cross-sectional view of third barrier structure 50 as shown across cross-sectional line VIII B in FIG. 8A. The geometry of the third structural zone having third barrier structure 50 is located between second barrier structure 40 and fourth barrier structure 60, along the perimeter of burner base 10. Specifically, third structural zone includes sloped bottom surface 18 extending, at a high end, from internal perimeter lip 15 down to a third barrier structure 50 at a low end. As depicted, third barrier structure 50 includes a semi-circular projection above bottom surface 18 that is adjacent to perimeter edge structure 12 and perimeter top surface 14.

Third barrier structure 50 includes a first end 54 and a second end 56. First end 54 interfaces with second barrier structure 40 and second end 56 interfaces with fourth barrier structure 60. According to the illustrated embodiment, third barrier structure extends above bottom surface 18 at a height 55. Third barrier structure 50 also includes a top surface 52 which may be sloped or may be in the plane that is parallel to perimeter top surface 14. As illustrated in FIG. 8B, top surface 52 is in a plane that is parallel to perimeter top surface 14, but is separated from perimeter top surface 14 by a distance 58.

Referring to FIG. 8B, in the illustrated embodiment, the height above bottom surface 18, i.e. height 57, is consistent along the length of third barrier structure 50. However, in other cases, a height along third barrier structure 50 may vary from the first end 54 to the second end 56 to produce different gas flow patterns within mixture chamber 112.

Figure 9A:
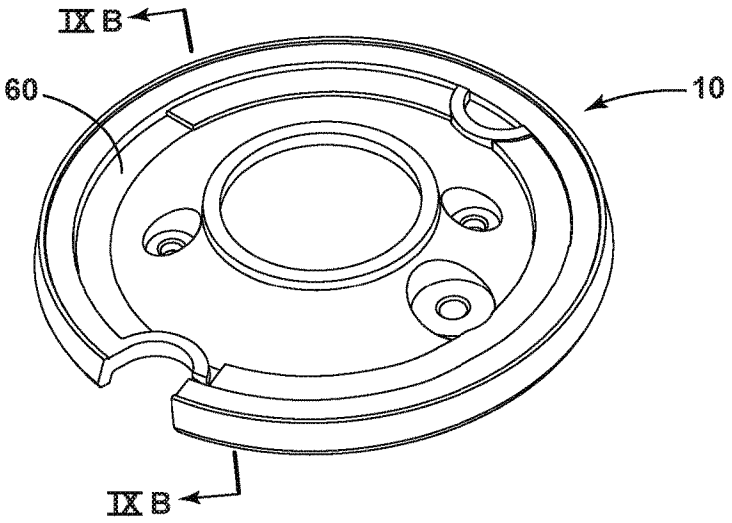
FIGS. 9A and 9B depict yet another side perspective view and a related cross-sectional view of the burner base, according to an embodiment of the present disclosure.
Figure 9B:
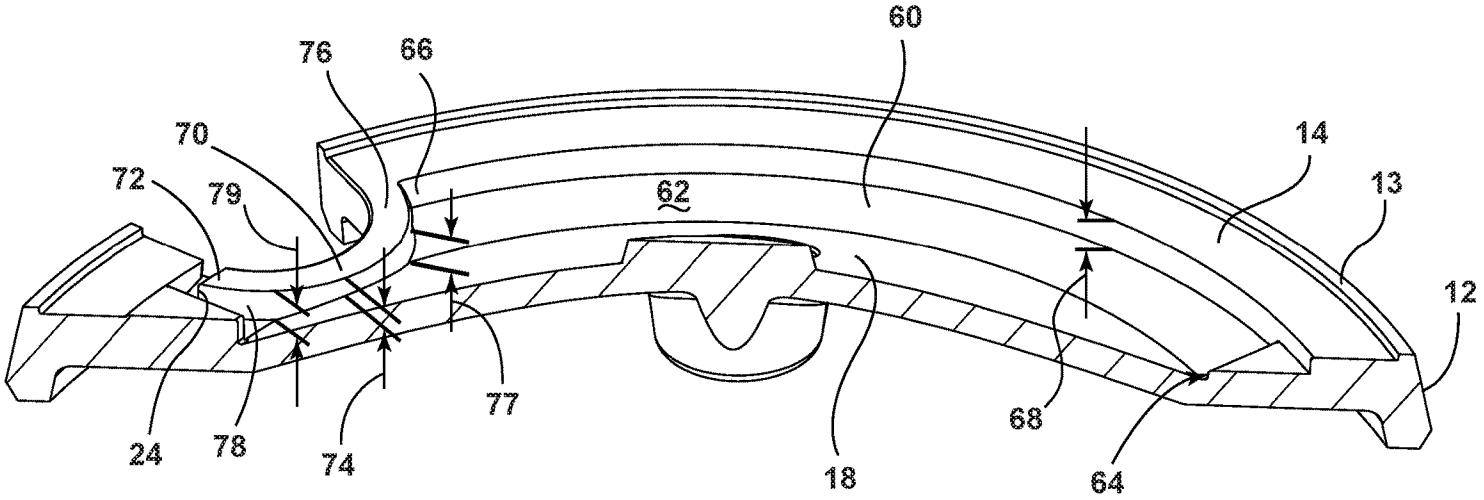

FIGS. 9A and 9B depict a top perspective view and a cross-sectional view, respectively, of a fourth structural zone having a fourth barrier structure 60 according to the illustrated embodiment. In particular, FIG. 9B is a top perspective cross-sectional view of fourth barrier structure 60 as shown across cross-sectional line IX B in FIG. 9A. The geometry of the fourth structural zone having fourth barrier structure 60 is located between third barrier structure 50 and ignition barrier structure 70, along the perimeter of burner base 10. Specifically, fourth structural zone includes sloped bottom surface 18 extending, at a high end, from internal perimeter lip 15 down to fourth barrier structure 60 at a low end. As depicted, fourth barrier structure 60 includes a semi-circular projection area extending away from bottom surface 18 to perimeter edge structure 12.

Fourth barrier structure 60 includes a first end 64 and a second end 66. First end 64 interfaces with third barrier structure 50 and second end 66 interfaces with ignition barrier structure 70. According to the illustrated embodiment, fourth barrier structure 60 extends away from bottom surface 18, without introducing a height to the fourth structural zone. Fourth barrier structure 60 also includes a top surface 62 which may be sloped or may be in a plane that is parallel to perimeter top surface 14. As illustrated in FIG. 9B, top surface 62 is in a plane that is parallel to perimeter top surface 14, but is separated from perimeter top surface 14 by a distance 68.

FIG. 9B also depicts ignition barrier structure 70, which is adjacent to fourth barrier structure 60 and ignition passage 24, which allows an ignition to be introduced into mixture chamber 112. In the illustrated embodiment, as discussed above, ignition barrier structure 70 may be located diametrically opposite from second barrier structure 40. Similar to the geometry of the second structural zone, ignition barrier structure 70 consists of a semi-circular arc structure that rises above bottom surface 18, with a peak or midpoint 73 oriented toward the center of burner base 10, a first end 76 proximate perimeter top surface 14, and a second end 78 proximate ignition passage 24.

Ignition barrier structure 70 rises above bottom surface 18 at a plurality of heights. First, ignition barrier structure 70 defines a midpoint height 74 at midpoint 73 from bottom surface 18 to a top surface 72. Ignition barrier structure 70 also defines a first end height 77 and a second end height 79. First end height 77 is defined between bottom surface 18 and top surface 72 where ignition barrier structure 70 interfaces with fourth barrier structure 60. Second end height 79 is defined between bottom surface 18 and top surface 72 where ignition barrier structure 70 interfaces with ignition passage 24. In some cases midpoint height 74 is different than first end height 77 and second end height 79. In at least one embodiment, midpoint height 74 is smaller than first end height 77 and second end height 79. In the illustrated embodiment, first end height 77 and second end height 79 are equal, and larger, than midpoint height 74. Further, as can be seen in FIG. 9B, in at least one embodiment, second end height 79 of ignition barrier structure 70 is substantially the same as the first end height 33 of first barrier structure 30. In other words, top surface 72 is in substantially the same plane as top surface 38 of first barrier structure 30 at the first end 32. In addition, according to the illustrated embodiment, at first end 76, top surface 72 of ignition barrier structure 70 is substantially higher than top surface 62 of fourth barrier structure 60. Further, top surface 72 is in substantially the same plane as perimeter top surface 14.

Figure 4:
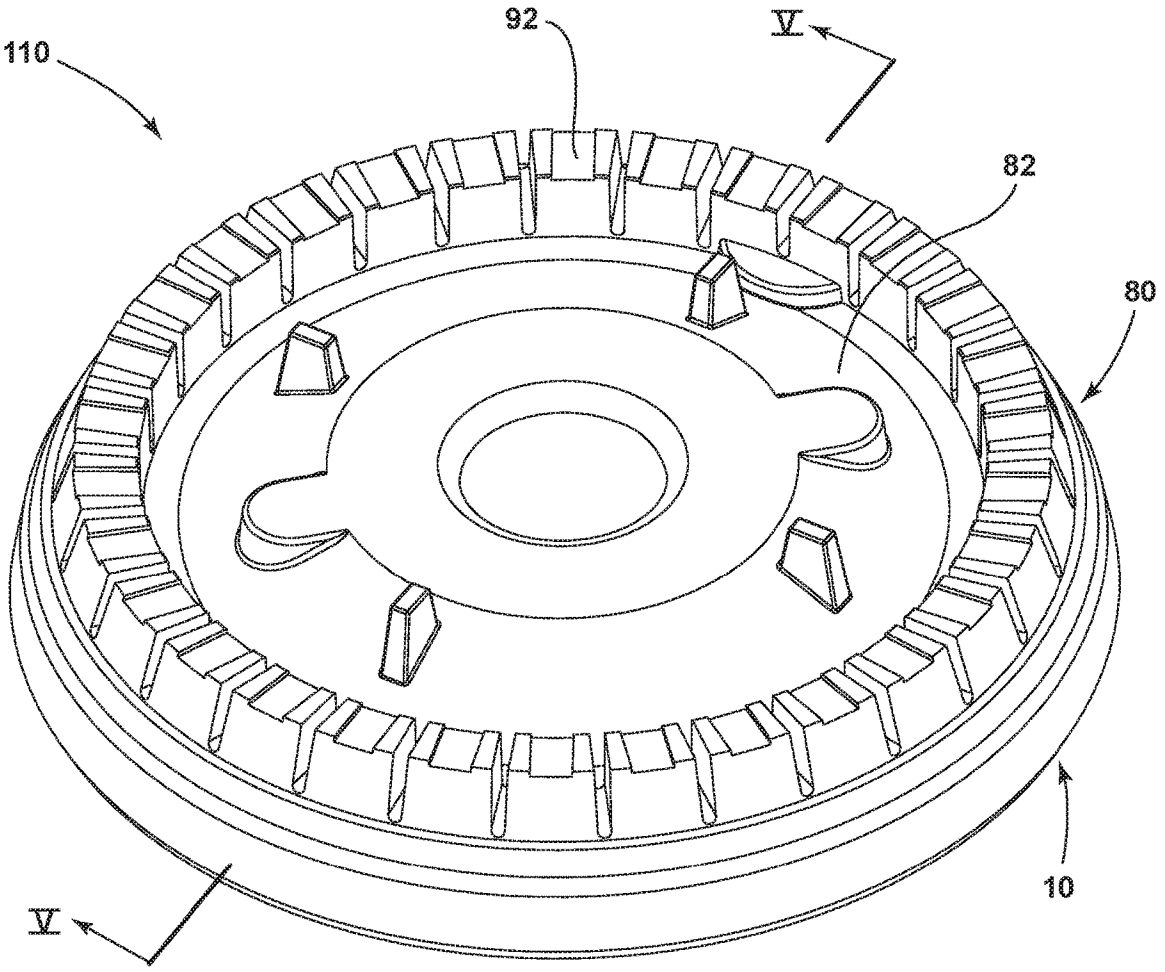
FIG. 4 is a top perspective view of a burner base assembly, according to an embodiment of the present disclosure.
Figure 5:
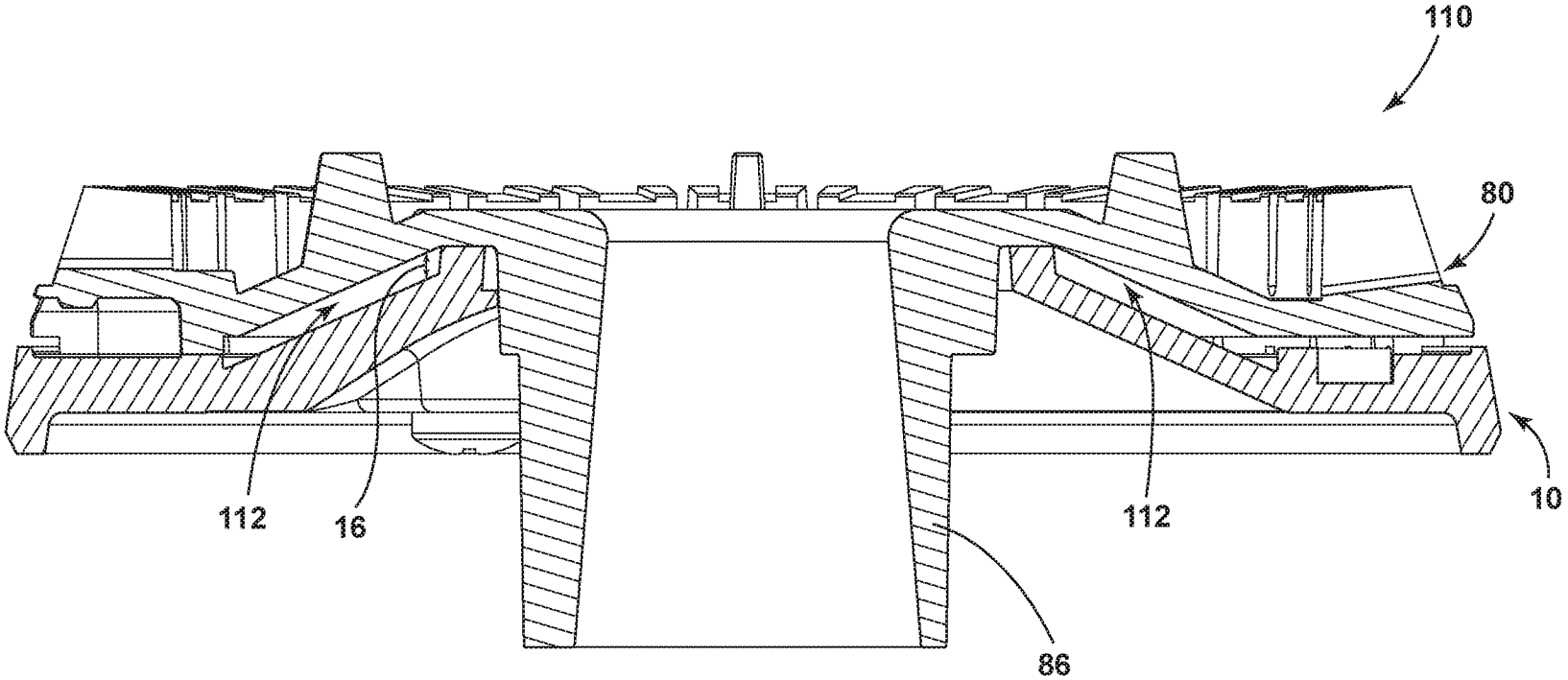
FIG. 5 is a cross-sectional view of the burner base assembly, according to an embodiment of the present disclosure.
Figure 10:
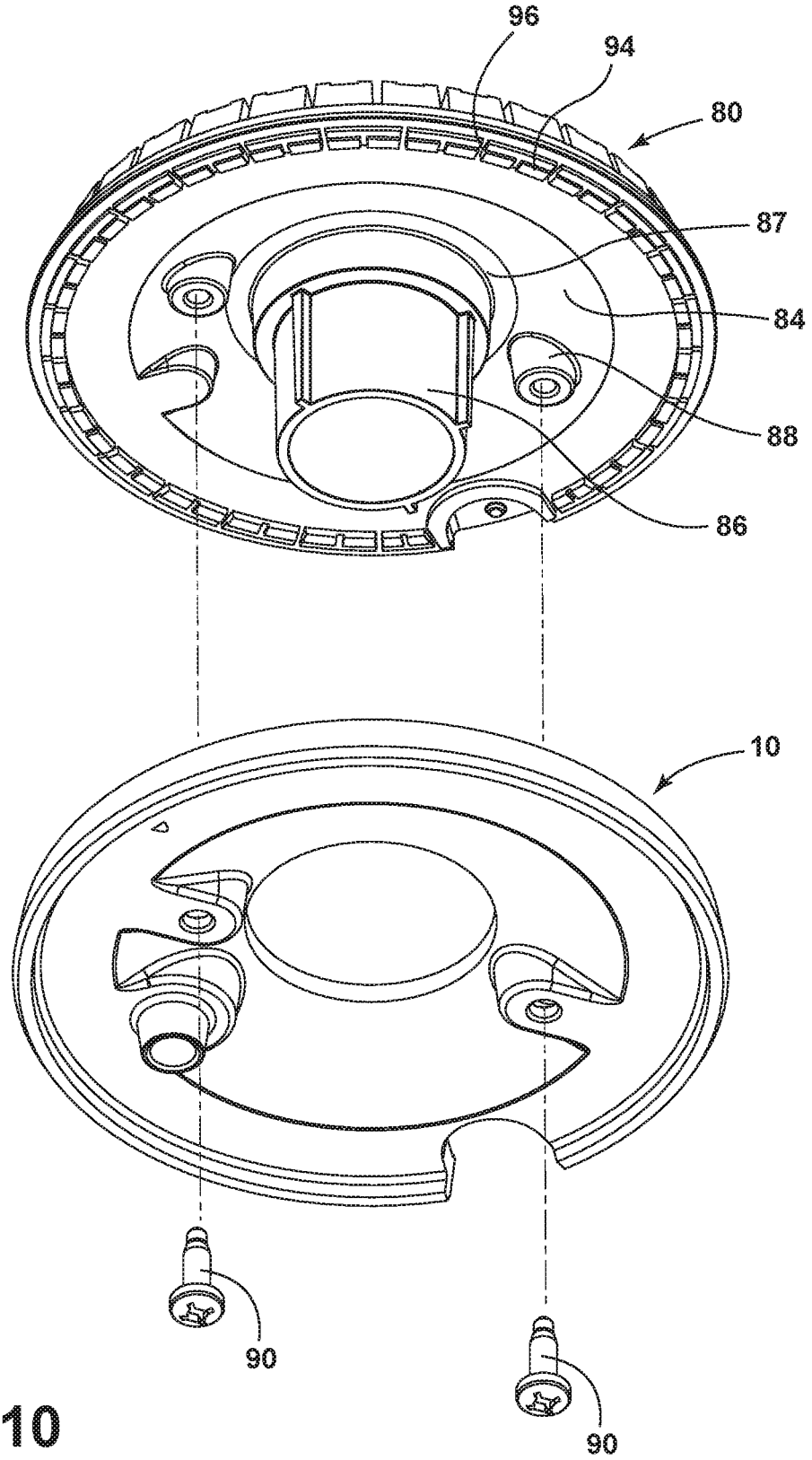
FIG. 10 depicts an exploded bottom perspective view of a burner assembly according to an embodiment described herein.

FIGS. 4, 5, and 10 depict burner spreader 80 of burner assembly 110 according to the illustrated embodiment. Burner spreader 80 includes a top surface 82 and a bottom surface 84 (FIG. 10). Top surface 82 includes a plurality of projections 92 that coincide with, and may be offset from, plurality of ridges 94 on the bottom surface 84. As can be seen in FIGS. 5 and 10, burner spreader 80 includes a central portion 86 that extends downward and is received within opening 17 of burner base 10. Accordingly, bottom surface 84 of burner spreader 80 and internal perimeter lip 15 create an upper barrier having a height 16 of mixture chamber 112. Ridges 94 of burner spreader 80 may further align with perimeter top surface 14 of burner base 10, creating openings 96 for gas and a cooking flame to be distributed around burner assembly 110. Burner spreader 80 further includes one or more securement apertures 88 that align with fixation apertures 20 of burner base 10 for securing burner assembly 110 to a cooktop appliance 100 or other cooktop surface. Burner assembly 110 may be secured with fasteners 90 as shown in FIG. 10 or other securement methods as would be known in the art.

When burner base 10 is coupled with a cover such as burner spreader 80, the various surface geometries of the burner base, together with the bottom surface 84 of burner spreader 80, may define the overall surface structure of mixture chamber 112. In operation, the overall surface structure of mixture chamber 112 may facilitate the flow of gas inside burner mixture chamber 112, enabling a cooking flame to exit the entire circular path of burner assembly 110. More specifically, the variable geometries of the first structural zone, the second structural zone, the third structural zone, and the fourth structural zone, as described herein, may create pressure differentials within mixture chamber 112 that effect the velocity and stability of the gas around the burner assembly 110. Thus, when gas is injected through injection port 26, and ignited by an ignition introduced through ignition passage 24, the pressure differentials created by the structural zones can serve to move the injected gas, and thus the cooking flame, consistently and stably around burner assembly 110.

As described above, the first barrier structure 30 of the first structural zone, the second barrier structure 40 of the second structural zone, the third barrier structure 50 of the third structural zone, the fourth barrier structure 60 of the fourth structural zone, as well as the ignition barrier structure 70, each comprise distinct surface geometries. Accordingly, in at least one embodiment, the radial cross-sectional area of the mixture chamber varies between the structural zones, and in some cases, varies along a single structural zone.

For example, in the illustrated embodiment, the variable height of first barrier structure 30 creates a variable radial cross-sectional area within mixture chamber 112 that causes gas injected through injection port 26 to be drawn away from middle section 36 and around the circle of burner base 10. In particular, because the middle section 36 of the first barrier structure 30 is taller (middle section height 37) than the first end 32 and the second end 34 (first end height 33 and second end height 35), a radial cross-sectional area of the middle section of the first structural zone is smaller than the radial cross-sectional areas at the ends of the first structural zone. Accordingly, the change in area, moving from the middle section, or proximate middle section 36, out to the ends, proximate first end 32 and the second end 34, creates a pressure differential. In at least one embodiment, due to the increase in the area of the mixture chamber 112, the pressure drops from the middle section 36 to the first end 32, and from the middle section to the second end 34. The pressure drop can cause the velocity of the gas to increase and the gas to be drawn from the gas injection port 26 and middle section 36 toward first end 32 and second end 34.

As previously discussed, second barrier structure 40 is geometrically similar to ignition barrier structure 70, which is located diametrically opposite from second barrier structure 40. Accordingly, second barrier structure 40 allows for the flow of gas at the first end 32 of first barrier structure 30 to mimic the flow of gas at the second end 34 of first barrier structure 30, creating a symmetrical flow at these locations within mixture chamber 112. Thus, in at least one embodiment, as the gas is moved toward the first end 32 and the second end 34 due to the geometry of the first structural zone, the symmetric structures of second barrier structure 40 and ignition barrier structure 70 help to ensure the symmetry and stability of the gas and cooking flame at the diametrically opposite areas of mixture chamber 112.

Third barrier structure 50, having a uniform height 57, creates a uniform geometry around the third structural zone as shown in FIG. 8B. This uniform geometry of mixture chamber 112 helps to create an even pressure in the zone opposite injection port 26 and reduces the volume of mixture chamber 112 as compared to the volumetric capacity at second end 34 of the first structural zone. Accordingly, the third barrier structure 50 creates yet another pressure differential, or drop in pressure, that causes gas to continue flowing around mixture chamber 112 from injection port 26 toward structural zone three and structural zone four, creating a steady, stable cooking flame around burner assembly 110.

It will be understood by one having ordinary skill in the art that construction of the described device and other components is not limited to any specific material. Other exemplary embodiments of the device disclosed herein may be formed from a wide variety of materials, unless described otherwise herein.

It is also important to note that the construction and arrangement of the various aspects of the burner base as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures and methods without departing from the concepts of the present device. Further, it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. A burner base for a cooking appliance burner assembly, the burner base comprising:

a gas mixture chamber defined by a burner base bottom surface, a perimeter edge located radially outward of the burner base bottom surface, the perimeter edge having a top surface at a uniform height above the lowest point of burner base bottom surface and a barrier lip extending above the height of the perimeter edge top surface;

a first barrier structure disposed along the perimeter edge of the gas mixture chamber and radially outward of the burner base bottom surface, the first barrier structure having a height at or below that of the outer perimeter edge top surface height;

a second barrier structure disposed along the perimeter edge of the gas mixture chamber and radially outward of the burner base bottom surface, the second barrier structure circumferentially adjacent to the first barrier structure to promote a symmetrical flow of gas relative to the first barrier structure; and a third barrier structure disposed along the perimeter edge of the gas mixture chamber and radially outward of the burner base bottom surface, the third barrier structure having a height below that of the outer perimeter edge top surface height and extending circumferentially adjacent to the second barrier structure such that the second barrier structure lies between the first and third barrier structures along the perimeter edge of the gas chamber;

wherein the first barrier structure, the second barrier structure, and the third barrier structure all have different relative geometries and lie interior to and are circumscribed by the outer perimeter edge to further promote a symmetrical flow of gas within the gas mixture chamber.

2. The burner base of claim 1, wherein a height of the first barrier structure above the bottom surface of the gas mixture chamber varies along a length of the first barrier structure.

3. The burner base of claim 2, wherein the height of the first barrier structure is taller at a midpoint of the first barrier structure than at either of two ends of the first barrier structure.

4. The burner base of claim 1, wherein the first barrier structure is located radially outwardly from a gas injection port.

5. The burner base of claim 1, wherein: a height of the second barrier structure relative to the bottom surface of the mixture chamber at an interface with the first barrier structure is taller than a height of the first barrier structure at the interface; and a height of the second barrier structure relative to the bottom surface of the mixture chamber at an interface with the third barrier structure is taller than a height of the third barrier structure at the interface.

6. The burner base of claim 1, wherein the second barrier structure is located diametrically opposite from an ignition barrier structure.

7. The burner base of claim 6, wherein the second barrier structure has a substantially similar geometry as the ignition barrier structure.

8. The burner base of claim 1, wherein: the second barrier structure comprises an arc inward of the first barrier structure; a peak of the arc is oriented toward a center of the burner base; and the arc provides symmetrical flow of gas at a first end and a second end of the first barrier structure.

9. The burner base of claim 1, wherein a height of the third barrier structure above the bottom surface of the gas mixture chamber is constant along a length of the third barrier structure.

10. The burner base of claim 1, wherein the first barrier structure, the second barrier structure, and the third barrier structure together define only a portion of the perimeter edge of the gas mixture chamber.

* * * * *